United States Patent [19]

Terauchi

[11] Patent Number: 4,477,238

[45] Date of Patent: Oct. 16, 1984

[54] SCROLL TYPE COMPRESSOR WITH WRAP PORTIONS OF DIFFERENT AXIAL HEIGHTS

[75] Inventor: Kiyoshi Terauchi, Isesaki, Japan

[73] Assignee: Sanden Corporation, Gunma, Japan

[21] Appl. No.: 469,143

[22] Filed: Feb. 23, 1983

[51] Int. Cl.[3] ..... F04C 18/02; F04C 23/00

[52] U.S. Cl. ..... 418/5; 418/55

[58] Field of Search ..... 418/5, 6, 55, 59

[56] References Cited

U.S. PATENT DOCUMENTS 3,874,827 4/1975 Young ..... 418/55

4,157,234 6/1979 Weaver et al. ..... 418/6

*Primary Examiner*—John J. Vrablik

*Attorney, Agent, or Firm*—Banner, Birch, McKie & Beckett

[57] ABSTRACT

A scroll type compressor is disclosed which includes a housing, a fixed scroll and an orbiting scroll. The fixed scroll is fixedly disposed relative to the housing and has a circular end plate from which a first spiral wrap extends. The spiral wraps interfit at an angular and a radial offset to make a plurality of line contacts to define at least one pair of sealed off fluid pockets. The fluid pockets move toward the center of the spiral wraps with consequent reduction of their volume by the orbital motion of the orbiting scroll. The spiral wrap of each scroll has a transition portion between a lower inner portion of the spiral wrap and a higher out portion thereof. The circular end plate of each scroll is provided with a stepped portion between a deeper outer portion of the end plate and a shallower inner portion thereof. The opposed transition and stepped portions are in registry, so that the higher spiral portions engage the deeper end plate portions, and the shorter spiral portions engage the shallower end plate portions.

13 Claims, 18 Drawing Figures

SCROLL TYPE COMPRESSOR WITH WRAP PORTIONS OF DIFFERENT AXIAL HEIGHTS

BACKGROUND OF THE INVENTION

This invention relates to a fluid displacement apparatus of the scroll type, such as a scroll type compressor.

Scroll type fluid displacement apparatus are well known in the prior art. For example, U.S. Pat. No. 801,182 discloses a scroll type fluid displacement apparatus including two scroll members, each having a circular end plate and a spiral or involute element. These scroll members are maintained angularly and radially offset so that both spiral elements interfit to make a plurality of line contacts between the spiral curved surfaces to thereby seal off and define at least one pair of fluid pockets. The relative orbital motion of the two scroll members shifts the line contacts along the spiral curved surfaces, and, therefore, the fluid pockets change in volume. The volume of the fluid pockets increases or decreases depending on the direction of the orbiting motion. Therefore, this scroll type fluid displacement apparatus is applicable to compress, expand or pump fluids.

The principle of operation of a typical scroll type compressor will be described with reference to FIGS. 1*a*–1*d*. FIGS. 1*a*–1*d* schematically illustrate the relative movement of interfitting spiral elements to compress the fluid and may be considered to be end views of a compressor wherein the end plates are removed and only the spiral elements are shown.

Two spiral elements 1 and 2 are angularly and radially offset and interfit with one another. As shown in FIG. 1*a*, orbiting spiral element 1 and fixed spiral element 2 make four line contacts as shown at four points A, B, C, D. A pair of fluid pockets 3*a* and 3*b* are defined between line contacts D-C and line contacts A-B, as shown by the dotted regions. Fluid pockets 3*a* and 3*b* are defined not only by the wall of spiral elements 1 and 2 but also by the end plates from which these spiral elements extend. When orbiting spiral element 1 is moved in relation to fixed spiral element 2 by, for example, a crank mechanism, so that the center O' of orbiting spiral element 1 revolves around the center O of fixed spiral element 2 with a radius of O—O', while rotation of the orbiting spiral element is prevented, the pair of fluid pockets 3*a* and 3*b* shift angularly and radially toward the center of the interfitting spiral elements with the volume of each fluid pocket 3*a* and 3*b* being gradually reduced, as shown in FIGS. 1*a*–1*d*. Therefore, the fluid in each pocket is compressed.

The pair of fluid pockets 3*a* and 3*b* are connected to one another while passing from the stage shown in FIG. 1*c* to that shown in 1*d*. As shown in FIG. 1*a*, both pockets 3*a* and 3*b* merge at center portion 5 and are completely connected to one another to form a single pocket. The volume of the connected single pocket is reduced by revolution of center O' about center O as shown in FIGS. 1*b*, 1*c* and 1*d*. During the course of revolution, outer spaces which open in the state shown in FIG. 1*b* change as shown in FIGS. 1*c*, 1*d* and 1*a* to form new sealed-off fluid pockets in which fluid is newly enclosed.

Accordingly, if circular end plates are disposed on, and sealed to, the axial facing ends of spiral elements 1 and 2, respectively, and if one of the end plates is provided with a discharge port 4 at the center thereof as shown, fluid is taken into the fluid pockets at the radial outer portion and is discharged from discharge port 4 after compression.

In a conventional scroll type compressor of the above type, if it is desired to increase the displacement or compression capacity, either the number of turns in the spiral elements must be increased or the axial length or "height" of the spiral elements must be increased. However, disadvantages result from an increase in the axial length of the spiral elements or an increase in the number of turns. For example, if the number of turns in the spirals element is increased, the diameter of the compressor also is increased.

Another disadvantage occurs by increasing the axial length of the entire spiral elements. Since the axial length of the spiral elements in conventional scroll type compressors is uniform and the end surface of the circular end plate is flat, the displacement volume of the fluid is proportional to the axial length of the spiral elements. The displacement volume of a scroll type compressor generally is defined by the outer fluid pocket space formed between the terminal outer end portion of the scroll member and the mid-way or central fluid space. The displacement of the outer fluid pockets formed by the spiral elements then is reduced due to a change of crank angle as shown in FIG. 2, which shows the volume change in one fluid pocket as a function of orbital motion. Line a in FIG. 2 illustrates the operation of a spiral element having an axial length $H_1$ and line b illustrates the operation of a spiral element having an axial length $H_2$, wherein $H_2$ is smaller than $H_1$. Thus, the volume of the fluid pockets formed by spiral elements having an axial length $H_2$ (line b) is smaller than the volume formed by spiral elements having an axial length $H_1$ (line a).

During operation of such a conventional scroll type compressor, when the volume of the fluid pockets is reduced as shown in FIG. 2, the gas or fluid pressure, which is proportional to the sectional area of the compressed chamber, increases. The greatest pressure occurs in the mid-way or central portion of the spiral elements. However, since the minimum volume of the central fluid pocket must be formed as small as possible in order to reduce the reexpansion volume, an increase in the axial length of the spiral elements in order to increase displacement or compression capacity has the disadvantage of increasing the reexpansion volume.

SUMMARY OF THE INVENTION

It is a primary object of this invention to provide an improved scroll type compressor which increases displacement volume without increasing the diameter of the compressor or increasing the reexpansion volume.

It is another object of this invention to provide a scroll type compressor wherein the rigidity of the spiral element is improved by increasing the axial length of the spiral elements of the scrolls.

It is still another object of this invention to realize the above objects with a simple compressor construction.

A scroll type compressor according to this invention comprises a housing and a pair of scrolls. One of the scrolls is fixedly disposed relative to the housing and has a circular end plate from which a first spiral wrap extends axially into the operative interior of the housing. The other scroll is movably disposed for non-rotative orbital movement within the interior of the housing. The orbiting scroll has a circular end plate from which a second wrap extends. The first and second spiral wraps interfit at an angular and radial offset to make a plurality of line contacts, thus defining at least one pair of sealed-off fluid pockets within the operative interior area of the housing. A driving mechanism is operatively connected to the orbiting scroll to effect its orbital motion, whereby the fluid pockets move inwardly and change in volume. A transition portion of the spiral wrap of one of the scrolls defines an inner wrap portion (extending inwardly of the transition portion) and an outer wrap portion (extending outwardly of the transition portion). The outer wrap portion has a greater axial length, or height, than the inner wrap portion. A stepped portion on the end plate of the other scroll is generally in registry with the transition portion. The stepped portion defines an inner end plate portion (extending within the wrap affixed to its end plate from the stepped portion toward the center of the scroll), and an outer end plate portion (extending within the wrap toward the periphery of the scroll). The outer end plate portion is deeper than the inner end plate portion to accommodate the higher outer wrap portion therein.

Further objects, features and aspects of this invention will be understood from the following detailed description of certain preferred embodiments of this invention, referring to the annexed drawings.

BRIEF DESCRIPTION OF THE DRAWINGS

FIGS. *1a–1d* are schematic views illustrating the general relative movement of conventional interfitting spiral elements to compress fluid.

Figure 3:
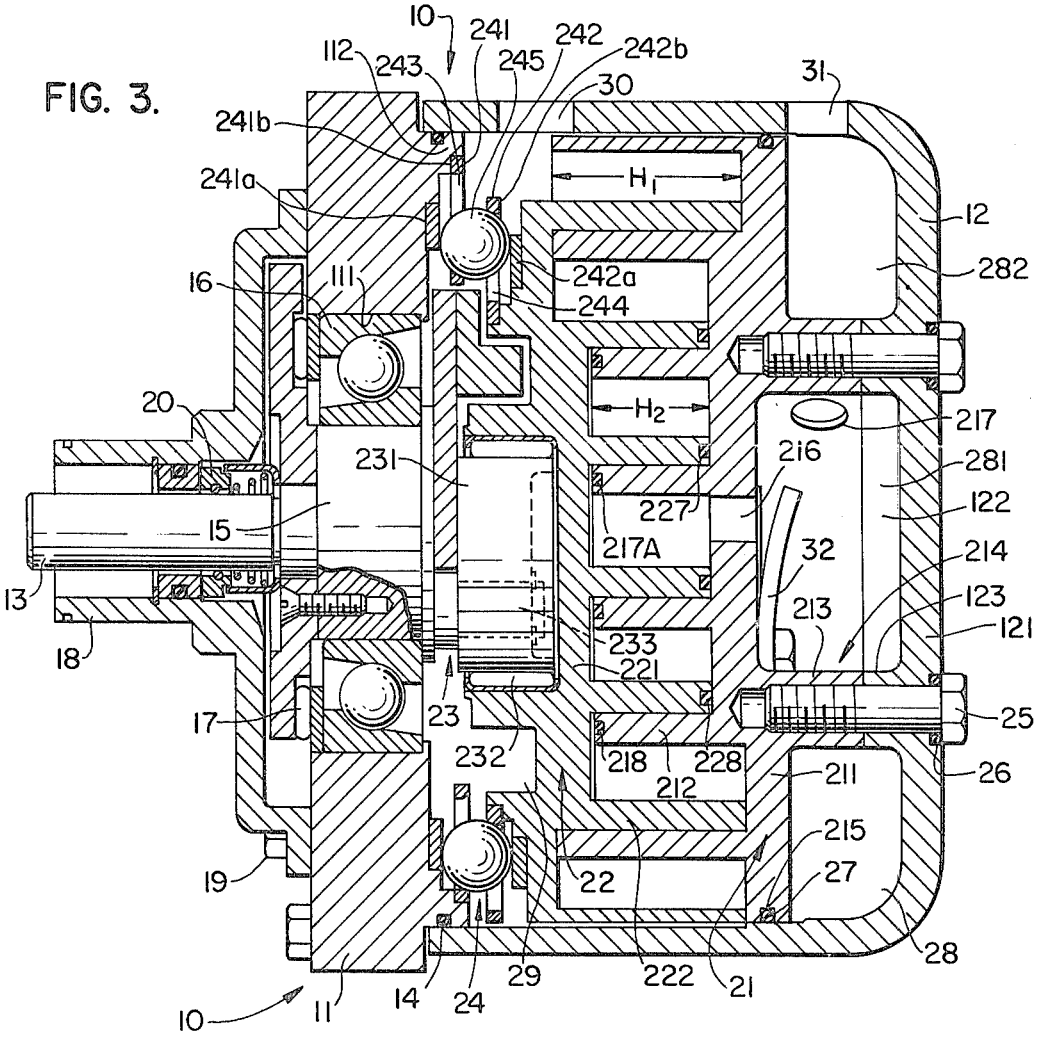
FIG. 3 is a vertical sectional view of a compressor of the scroll type according to this invention.
Figure 4A:
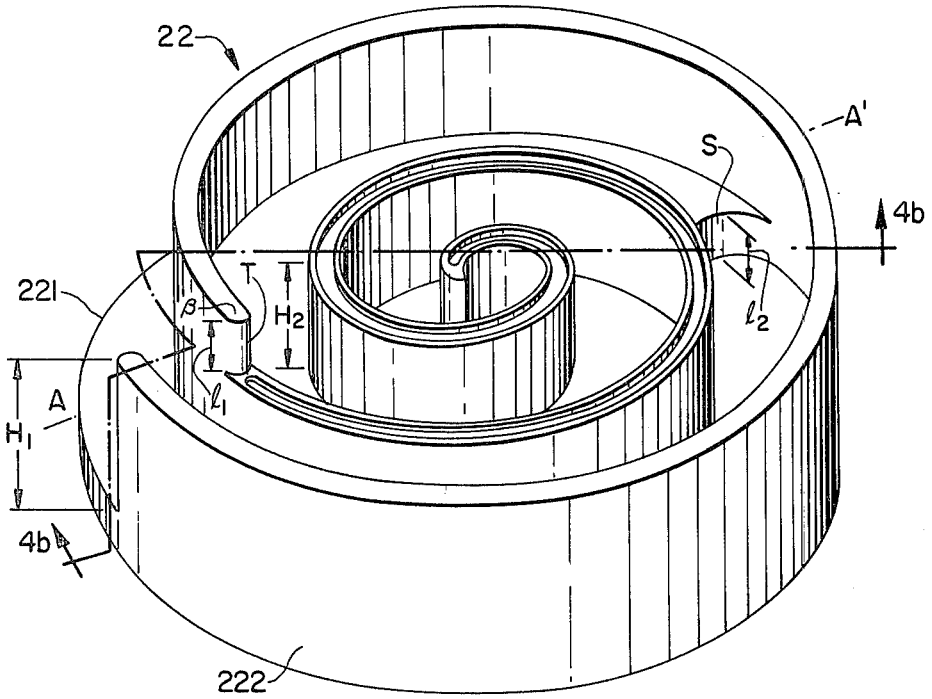
Figure 4B:
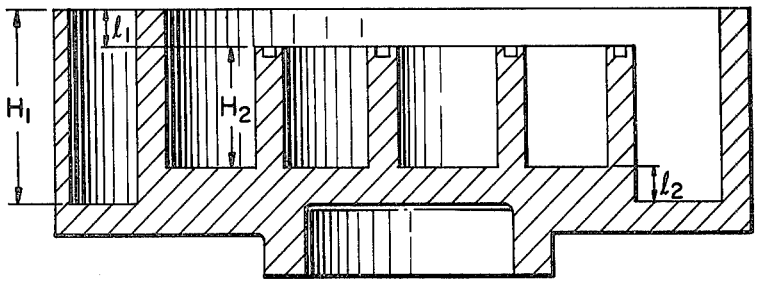
Figure 5A:
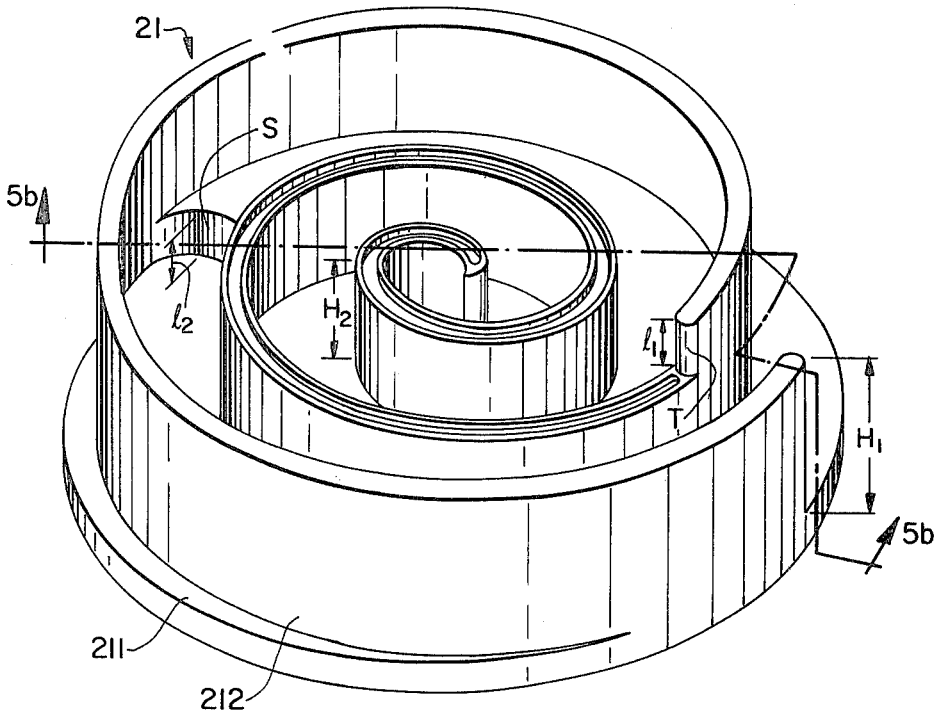
Figure 5B:
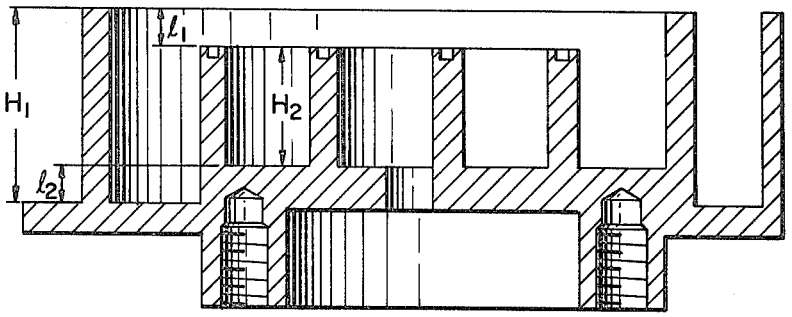

FIG. *4a* is a perspective view of the orbiting scroll used in the compressor in FIG. 3.

FIG. *4b* is a vertical sectional view taken along line *4b–4b* in FIG. *4a*.

FIG. *5a* is a perspective view of the fixed scroll used in the compressor in FIG. 3.

FIG. *5b* is a vertical sectional view taken along line *5b—5b* in FIG. *5a*.

Figure 6:
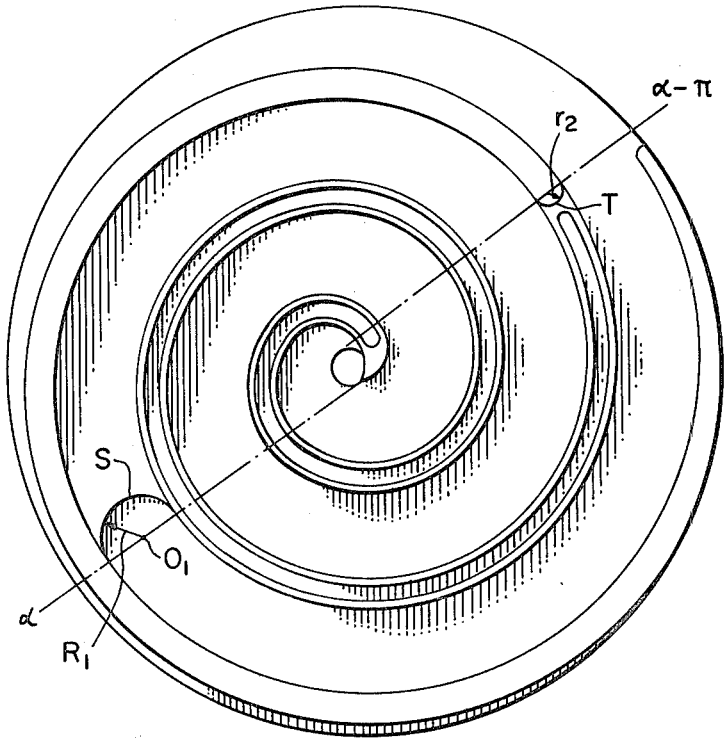

FIG. 6 is a front-end view of the fixed scroll used in the compressor in FIG. 3.

FIGS. *7a–7d* are schematic views illustrating the relative movement of the interfitting spiral elements which are shown in FIG. 3.

FIG. *8a* is a front end view of the fixed scroll according to another embodiment of this invention.

FIG. *8b* is a vertical sectional view taken along line *8b—8b* in FIG. *8a*.

Figure 9:
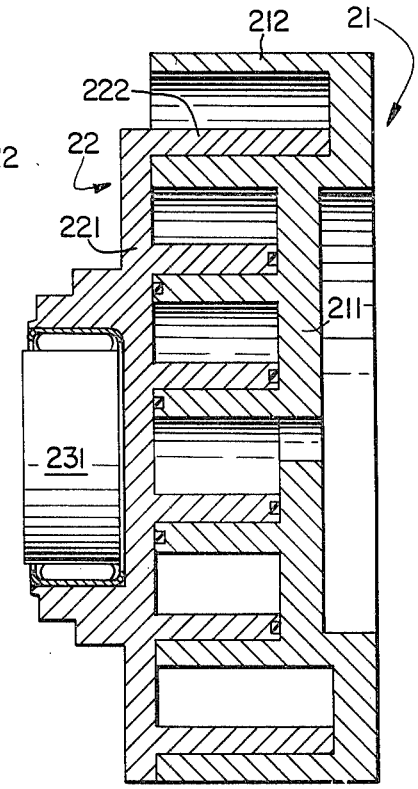

FIG. 9 is a vertical sectional view illustrating the interfitting relationship of both scrolls according to still another embodiment of the invention.

DESCRIPTION OF THE PREFERRED EMBODIMENTS

Referring to FIG. 3, a scroll type refrigerant compressor according to this invention is shown. The compressor includes compressor housing 10 having front end plate 11 and cup-shaped casing 12 fastened to an end surface of front end plate 11. Opening 111 is formed on the center of front end plate 11 for supporting drive shaft 13. Annular projection 112, concentric with opening 111, is formed on the inside surface of front end plate 11 which faces casing 12. Annular projection 112 fits into an inner wall of the opening of cup-shaped casing 12. Cup-shaped casing 12 is fixed on the inside surface of front end plate 11 by suitable fasteners, such as bolts and nuts (not shown), so that the opening of cup-shaped casing 12 is covered by front end plate 11. An O-ring 14 is placed between the outer peripheral surface of annular projection 112 and the inner wall of cup-shaped casing 12 to seal the mating surfaces between front end plate 11 and cup-shaped casing 12.

Drive shaft is formed with a disk-shaped rotor 15 at its inner end portion. Disk-shaped rotor 15 is rotatably supported by front end plate 11 through bearing 16 located within opening 111 of front end plate 11. Front end plate 11 has annular sleeve 18 projecting from the front end surface thereof. This sleeve 18 surrounds drive shaft 13 to define a shaft seal cavity. Shaft seal assembly 20 is assembled on drive shaft 13 within the shaft seal cavity. As shown in FIG. 3, sleeve 18 is attached to the front end surface of front end plate 11 by screws 19. Alternatively, sleeve 18 may be formed integral with front end plate 11.

The outer end of drive shaft 13 which extends from sleeve 18 is connected to a rotation transmitting device, for example, a magnetic clutch which may be disposed on the outer peripheral surface of sleeve 18 for transmitting rotary movement to drive shaft 13. Thus, drive shaft 13 is driven by an external power source, for example, the engine of a vehicle, through the rotation transmitting device.

A number of elements are located within the inner chamber of cup-shaped casing 12 including fixed scroll 21, orbiting scroll 22, driving mechanism 23 for orbiting scroll 22 and rotation-preventing/thrust-bearing device 24 formed between the inner wall of cup-shaped casing 12 and the rear end surface of front end plate 11.

Fixed scroll 21 includes circular end plate 211, wrap or spiral element 212 affixed to or extending from one end surface of circular end plate 211, and annular partition wall 213 axially projecting from the end surface of circular end plate 211 on the side opposite spiral element 212. Annular partition wall 213 is formed with a plurality of equiangularly spaced threaded bosses 214 which mate with annular partition wall 122 and hollow bosses 123 on the inner surface of end wall 121 of cup-shaped casing 12. Partition wall 213 is secured to casing 12 by a plurality of bolts 25 (two bolts 25 are shown in FIG. 3). Seal ring 26 is placed under the head of each bolt 25 to prevent fluid leakage past bolts 25.

Circular end plate 211 of fixed scroll 21 thus partitions the inner chamber of cup-shaped casing 12 into discharge chamber 28 having partition walls 213, 122, and suction chamber 29, in which spiral element 212 of fixed scroll 12 is located. Sealing member 27 is disposed within circumferential groove 215 on circular end plate 211 for sealing the outer peripheral surface of circular end plate 211 to the inner wall of cup-shaped casing 12. Since partition walls 213, 122 are located within discharge chamber 28, discharge chamber 28 is partitioned into central space 281 and outer space 282, and both spaces 281 and 282 are connected to one another through hole 217 formed in partition walls 213, 122.

Orbiting scroll 22, which is disposed in suction chamber 29, includes circular end plate 221 and wrap or spiral element 222 affixed to and extending from one end surface of circular end plate 211. Spiral elements 212 and 222 interfit at an angular offset of 180° and a predetermined radial offset. The spiral elements define at least one pair of fluid pockets between their interfitting surfaces. Axial sealing elements 217, 227 are retained in end grooves 218, 228 of spiral elements 212, 222 to effect axial sealing with end plates 22, 21, respectively.

Orbiting scroll 22 is rotatably supported on bushing 231 through a bearing such as radial bearing 232. Bushing 231 is connected to crank pin 233 eccentrically projecting from the end surface of disk-shaped rotor 15. Thus, orbiting scroll 22 is rotatably supported on crank pin 233 and is moved by the rotation of drive shaft 13.

Rotation-preventing/thrust-bearing device 24 is placed between the inner end surface of end plate 11 and the end surface of circular end plate 221 of orbiting scroll 222 which faces the inner end surface of front end plate 11. Rotation-preventing/thrust-bearing device 24 includes fixed ring 241 which is fastened against the inner surface of front end plate 11, orbiting ring 242 which is fastened against the end surface of circular end plate 221, and bearing elements, such as a plurality of spherical balls 245. Both rings 241 and 242 have a plurality of pairs of adjacent circular indentations or holes 243 and 244 and one ball 245 is retained in each of these pairs of holes 243 and 244. As shown in FIG. 3, both rings 241 and 242 are formed by separate plate elements **241*a* and 242*a* and ring elements 241*b* and 242*b* which have the plurality of pairs of holes 243, 244**. The elements of each ring are respectively fixed by suitable fastening means. Alternatively, the plate and ring elements may be formed integral with one another.

In operation, the rotation of orbiting scroll 22 is prevented by balls 245, which interact with the edges of holes 243, 244 to prevent rotation. Also, these balls 245 carry the axial thrust load from orbiting scroll 22. Thus, orbiting scroll 22 orbits while maintaining its angular orientation with respect to fixed scroll 21.

Fluid inlet port 30 and fluid outlet port 31 are formed on cup-shaped casing 12 for communicating between the inner chamber of cup-shaped casing 12 and an external fluid circuit. Therefore, fluid or refrigerant gas, introduced into suction chamber 29 from an external fluid circuit through inlet port 30, is taken into the fluid pockets formed between spiral elements 212 and 222. As orbiting scroll 22 orbits, fluid in the fluid pockets moves to the center of the interfitting spiral elements with consequent reduction of volume thereof. Compressed fluid is discharged into discharge chamber 28 from the fluid pocket at the center of spiral end plate 211 via reed valve 32, and therefrom is discharged through outlet port 31 to an external fluid circuit.

Referring to FIGS. **4*a*, 4*b*, 5*a*, 5*b* and 6**, the configuration of the scrolls according to this invention will be described in more detail. The configuration of the two scrolls is essentially identical, except that, of course, one is essentially the mirror image of the other. In the description that follows, the term "height" is used to describe the axial extent of a spiral element from its connection with its end plate to its axial end surface.

The outer end portion of orbiting spiral element 222 has a height $H_1$. The inner end surface of end plate 221 is formed with stepped portion S at an arbitrary involute angle $\alpha$ on the inner side of orbiting spiral element 222 (this point is shown by $O_1$ in FIG. 6, which actually depicts the spiral element of fixed scroll 21—the mirror image of orbiting scroll 22). This stepped portion S has a depth $l_2$. Thus, the inner portion of end plate 221, which extends inwardly from this stepped portion S to the center of the spiral, is formed shallower than its outer portion. The end surface of stepped portion S is concavely semicircular with a radius $R_1$; this radius $R_1$ is given by $R_1=r_o+t/2$, where $r_o$ is the orbital radius of orbiting scroll 22 and t is the wall thickness of the spiral element. This arcurate end surface of stepped portion S provides clearance for mating fixed spiral element 212, which faces stepped portion S, during orbital motion of scroll 22. Furthermore, orbiting spiral element 222 is formed with a transition portion T at position $\alpha-\pi$ angularly offset from the point $O_1$ by $\pi$ radians, where the spiral height is decreased by $l_1$. Hence, the inner portion of orbiting spiral element 222, i.e., from the inner end of the spiral to the transition portion T, has a height $H_2=H_1-l_1-l_2$. The end surface of transition portion T is convexly semicircular with a radius $r_2$. The radius $r_2$ is given by $r_2=t/2$.

As shown in FIGS. **5*a* and 5*b*, the configuration of fixed scroll 21, which mates with orbiting scroll 22, is essentially the mirror image of the configuration of orbiting scroll 22. Thus, a stepped portion S having a depth of $l_2$ is formed on the end surface of circular end plate 211 at a point $O_1$ shown in FIG. 6, and fixed spiral element 212** is provided with a transition portion T at a position $\alpha-\pi$ angularly offset from point $O_1$ by $\pi$ radians, where the spiral height is decreased by $l_1$. Hence, when both scrolls interfit with one another to make a plurality of line contacts, each transition portion T of one scroll is opposed by a stepped portion S of the opposing scroll.

Figure 7A:
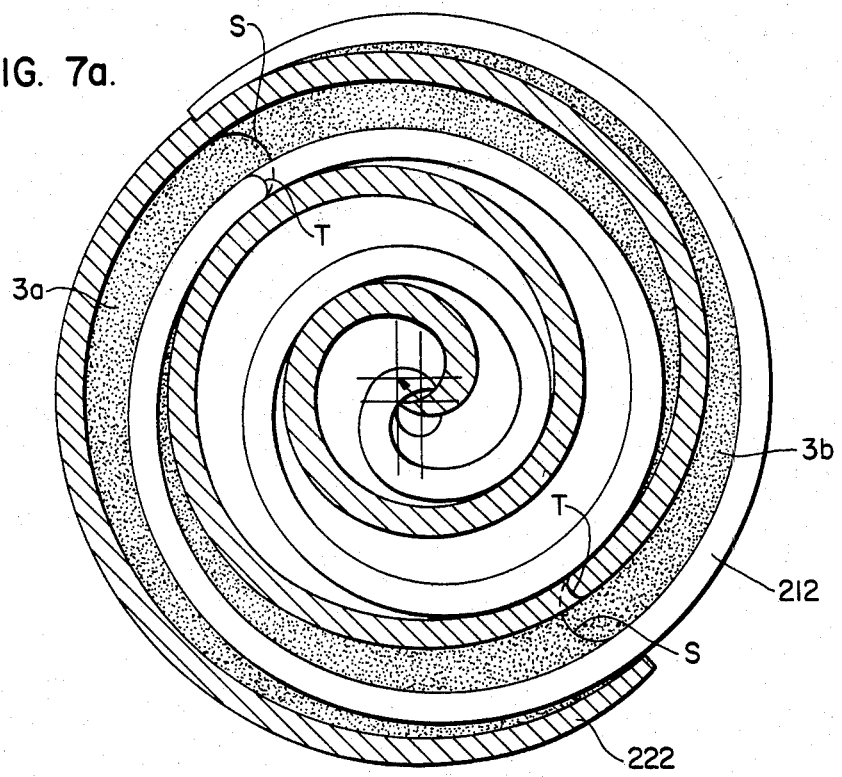
Figure 7B:
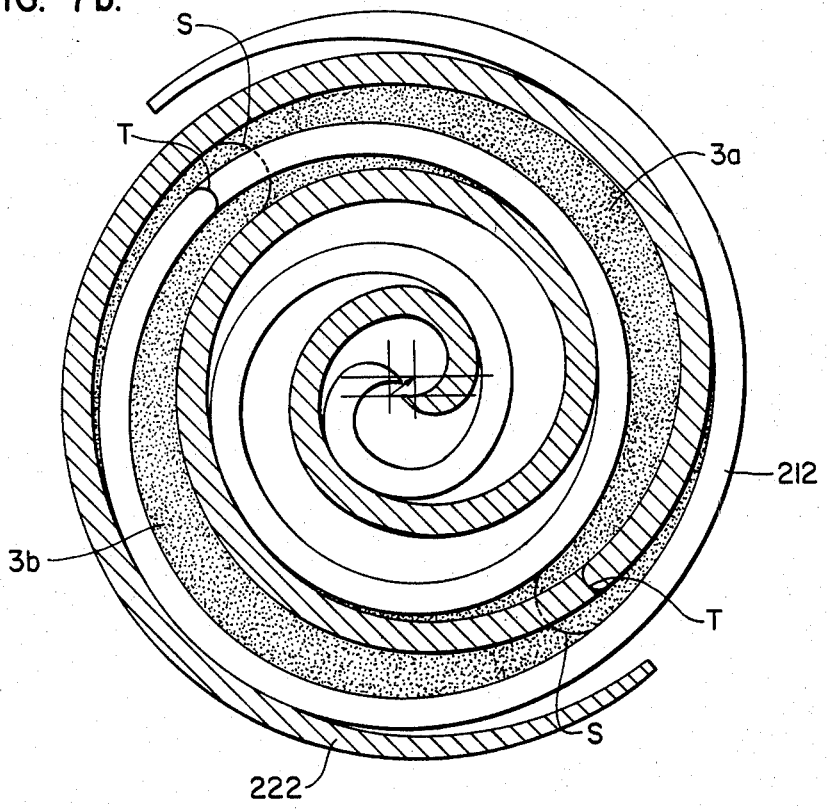
Figure 7C:
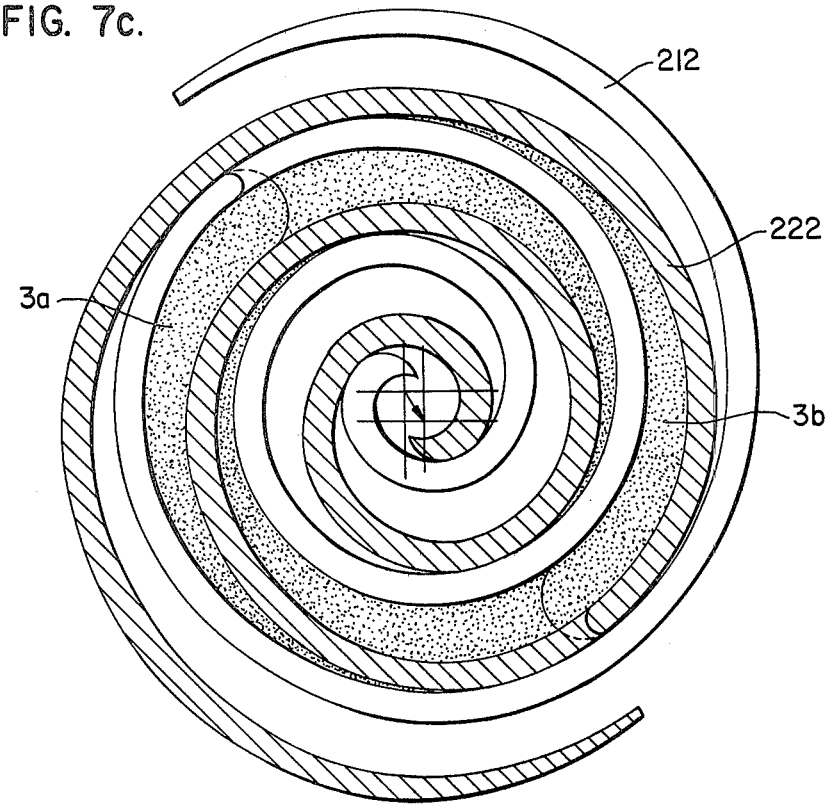

The operation of the above-described compressor now will be explained with reference to FIGS. **7*a*–7*d*. As mentioned above, spiral elements 212 and 222 are angularly and radially offset and interfit with one another. FIG. 7*a* shows that the outer terminal end of each spiral element is in contact with the other spiral element, i.e., suction just has been completed, and a symmetrical pair of fluid pockets 3*a* and 3*b* has been formed. For each spiral element, stepped portion S is located $\pi$ radians from the outer terminal end of the spiral element. Hence, about half of the part of the spiral element which defines the fluid pockets 3*a* and 3*b* has height $H_1$, and the remainder of the spiral element has height of $H_1-l_1-l_2$. In the stage of compression illustrated in FIG. 7*a*, the end surface of transition portion T of one spiral element interfits with the end surface of the stepped portion S of the opposite scroll, thus sealing off the pair of fluid pockets 3*a* and 3*b***.

FIG. **7*b* shows the state of the scrolls at a drive shaft crank angle which is advanced 90° from that in FIG. 7*a*. In this state, there is no contact between transitional portion T and stepped portion S so that the pair of fluid pockets 3*a*, 3*b* are connected to one another through a gap between stepped portion S and transition portion T. However, the pair of fluid pockets 3*a*, 3*b* are symetrically formed by the scrolls and have the same fluid pressure therein, so that compression loss does not result. The fluid pressure in fluid pockets 3*a*, 3*b*** is equalized in this state. Therefore, pressure imbalance between the pair of fluid pockets, which may be caused by dimensional inaccuracies in the spiral elements or other reasons, will not occur.

FIG. **7*c*** shows the relationship between the scrolls at a further 90° the rotation of drive shaft. In this state, contact between transition portions T and stepped portions S has been newly formed, so that the fluid in the pair of pockets is further compressed.

Figure 7D:
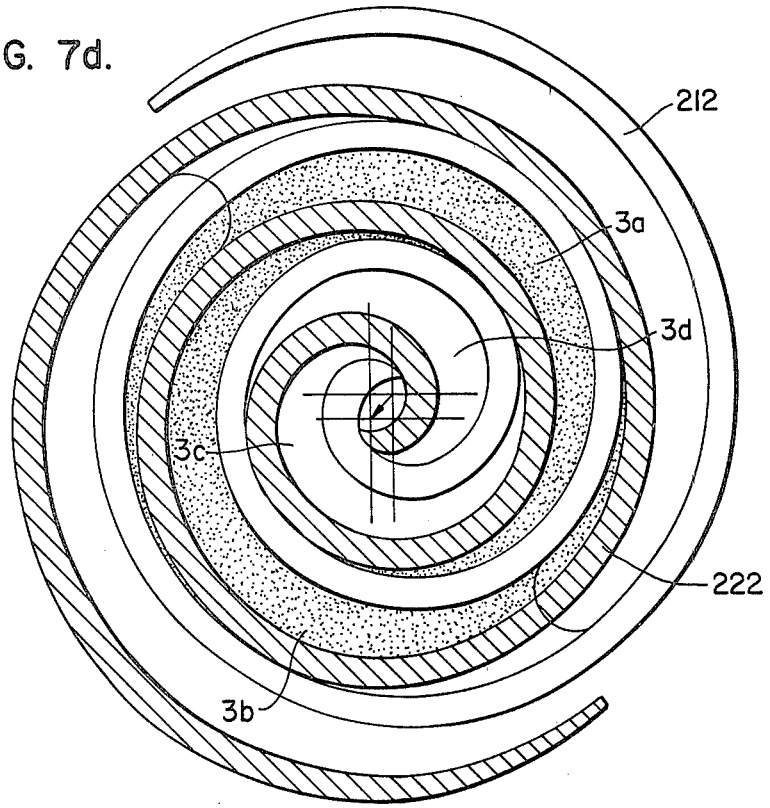

FIG. **7*d* shows the relationship between the scrolls at a further 90° rotation of the drive shaft. In this state, the parts of the spiral elements which define the pair of fluid pockets 3*a*, 3*b*** have a height of $H_2=H_1-l_1-l_2$. As illustrated in FIGS. 7a–7d, of the portions of the spiral elements which define the fluid pockets 3a, 3b, the percentage constituted by the lower segments (having heights $H_2=H_1-l_1-l_2$) increases with further rotation of the drive shaft. In FIG. 7d, the pair of fluid pockets 3c and 3d are defined by the parts of the spiral portions which have a height of $H_2$. Hence, the axial length of the fluid pockets is reduced as the spiral elements continue to orbit in response to the further rotation of the drive shaft.

Figure 1A:
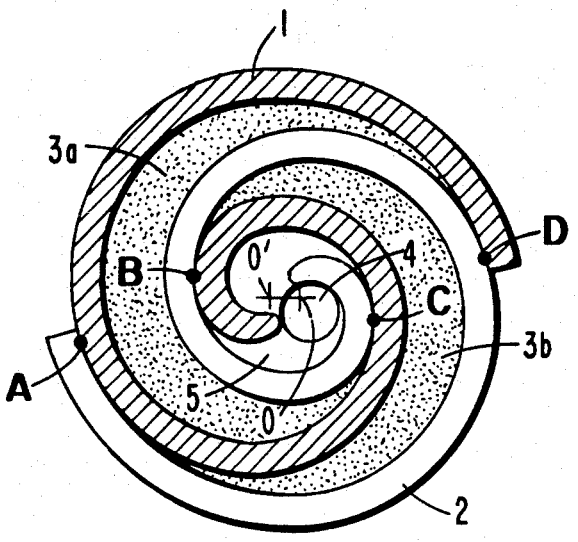
Figure 1B:
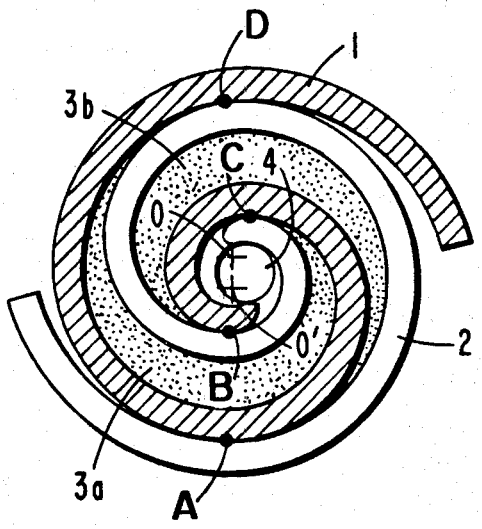
Figure 1C:
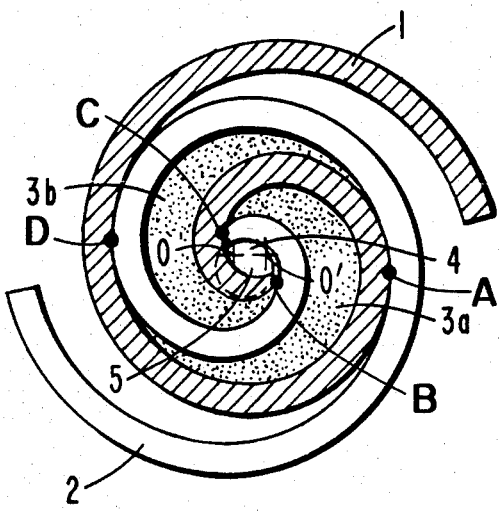
Figure 1D:
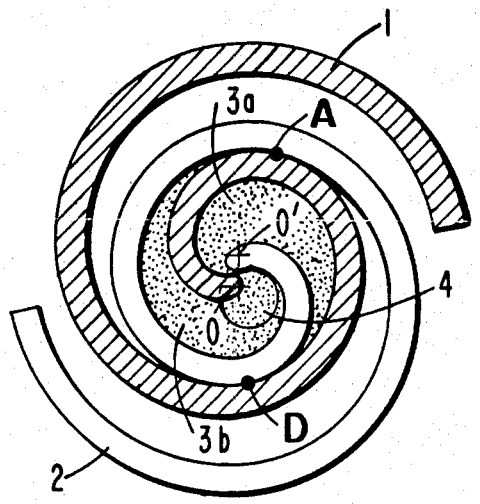
Figure 2:
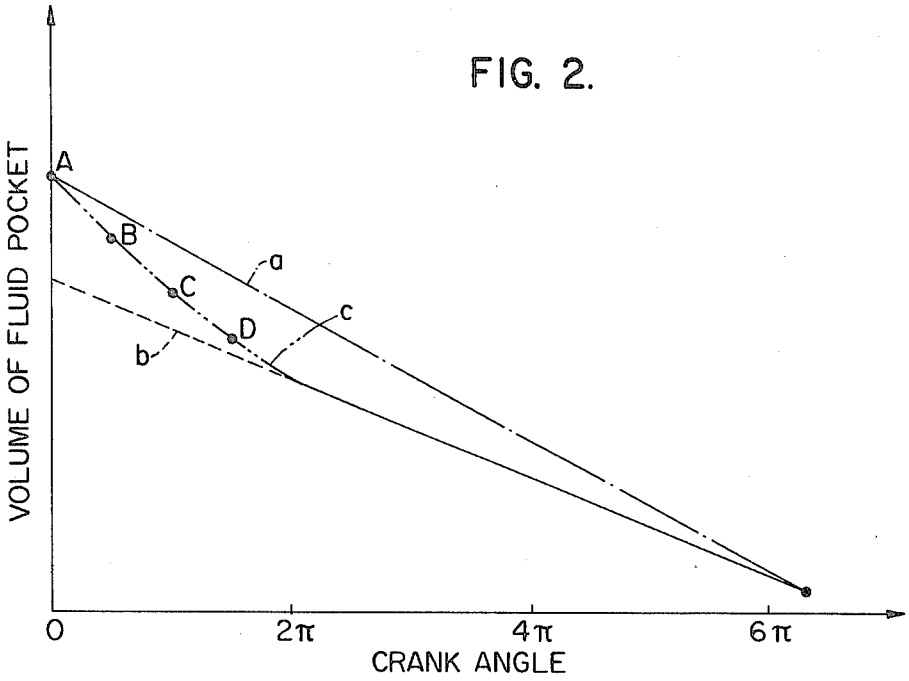
FIG. 2 is a volume-crank angle diagram illustrating the volume change in one of the fluid pockets for three different shaped spiral elements.

FIG. 2 illustrates the volume change in one of the fluid pockets due to the rotation of the drive shaft. In this figure, lines a and b show the volume change for spiral elements of uniform height. Line a shows the volume change for a spiral element of height $H_1$ and line b for height $H_2$, where $H_2$ is less than $H_1$. Line c shows volume change the spiral elements of varying height of this invention. Four points A–D in line c are correspondent to the states of pockets 3a and 3b in FIGS. 7a–7d. In comparison with the volume changes of the fluid pockets for conventional spiral elements, during the initial compression state the volume change ratio to the crank angle is greater. However, in the last state, the volume change ratio is less.

As mentioned above, the height of the center portion of the spiral elements is less than the outer portion of spiral elements, therefore the displacement volume at the outer end portion of the spiral element is greater. Since the height of the center portion of the spiral element, which defines the high pressure space, can be reduced, the rigidity of the spiral elements is improved and, accordingly, the manufacture of the scroll is more easily accomplished.

Also, since the volume change ratio in the lower pressure area is greater than in the high pressure area, the compression load to crank angle is greater and hence the torque change is reduced. Furthermore, since the volume in the central fluid pocket which is connected to the discharge chamber is reduced, the reexpansion volume is reduced to thereby reduce the power loss of the compressor.

Figure 8A:
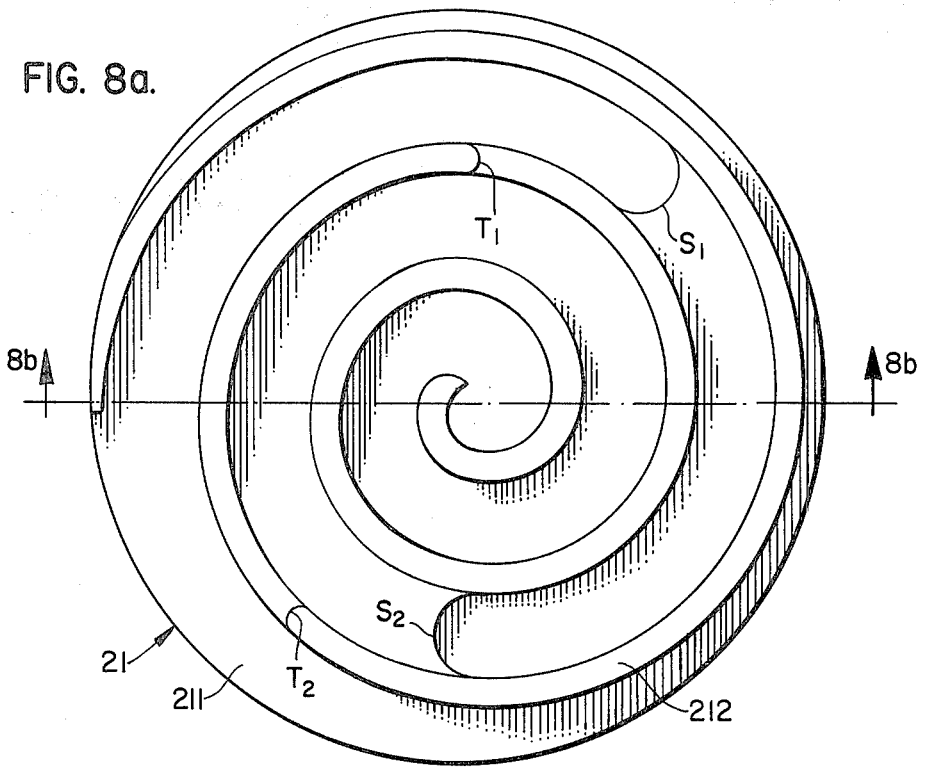
Figure 8B:
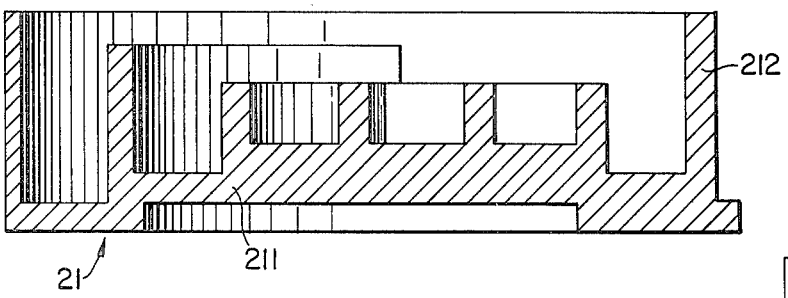

Referring to FIGS. 8a and 8b, another embodiment is shown. This embodiment is directed to a modification of the scroll which is provided with a plurality of stepped portions and transition portions. In this embodiment, end plates 211 and 221 are provided with two stepped portions $S_1$ and $S_2$, each of which is arcuate. Also, spiral elements 212, 222 are provided with two transition portions $T_1$ and $T_2$, each end surface of which is arcuate.

Referring to FIG. 9, still another embodiment is shown. This embodiment is directed to a modification of the configuration of the scroll. Circular end plate 221 of orbiting scroll 22 is formed with a flat surface and spiral element 222 is provided with a transition portion for changing the spiral height. Spiral element 222 has a lower portion from the transition portion to the internal spiral end. Circular end plate 211 of fixed scroll 21 has a stepped portion, which also changes the height of the spiral element. There is a difference in the number of turns in the two spiral elements as shown in FIG. 9. This difference equalizes the volume in a pair of fluid pockets formed simultaneously at the periphery of the spiral elements to thereby balance the fluid pressure in the outer pockets formed by the scrolls. In this embodiment, an imbalance would otherwise exist if the spiral elements had the same number of turns.

The invention has been described in detail in connection with certain preferred embodiments, but these are examples only and this invention is not restricted thereto. It will be easily understood by those skilled in the art that other variations and modifications can be easily made within the scope of this invention, as defined by the appended claims.

I claim:

1. In a scroll type compressor including a housing having a fluid inlet port and a fluid outlet port, a fixed scroll fixedly disposed relative to said housing and having a circular end plate from which a first spiral wrap extends axially into an operative interior area of said housing, an orbiting scroll having a circular end plate from which a second spiral wrap extends axially, said first and second spiral wraps interfitting at an angular and radial offset to make a plurality of line contacts to define at least one pair of sealed-off fluid pockets within said operative interior area, a driving mechanism operatively connected to said orbiting scroll to effect orbital motion of said orbiting scroll so that the volume of the fluid pockets changes during the orbital motion of said orbiting scroll, the improvement comprising:

a transition portion on the spiral wrap of one of said scrolls, said transition portion defining an inner wrap portion extending from said transition portion toward the inner end of the spiral wrap and an outer wrap portion extending from said transition portion toward the outer end of the spiral wrap, said outer wrap portion having a greater axial height than said inner wrap portion; and a stepped portion on the end plate of the other of said scrolls in registry with said transition portion during at least a portion of the relative orbital movement of said scrolls, said stepped portion defining an inner end plate portion extending from said stepped portion toward the center of the end plate and an outer end plate portion extending from said stepped portion toward the periphery of the end plate, said outer end plate portion being deeper than said inner end plate portion to accommodate said outer wrap portion therein.

2. A scroll type compressor according to claim 1 wherein said transition portion and said stepped portion are adapted to mutually effect a fluid seal therebetween during at least a portion of the orbital movement of said orbiting scroll.

3. A scroll type compressor according to claim 1 wherein said transition portion is convexly arcuate, and said stepped portion is concavely arcuate to permit orbital motion of said transition portion adjacent said stepped portion.

4. A scroll type compressor according to claim 1 wherein each of said spiral wraps has a transition portion, and each of said end plates has a stepped portion, and said stepped portions are opposed to and in registry with said transition portions.

5. A scroll type compressor according to claim 4 wherein said opposed transition and stepped portions are adapted to mutually effect fluid seals therebetween during at least a portion of the orbital movement of said orbiting scroll member.

6. A scroll type compressor according to claim 4 wherein said transition portions are convexly arcuate, and said stepped portions are concavely arcuate to permit orbital motion of said transition portions adjacent said stepped portions.

7. A scroll type compressor according to claim 4 wherein each of said scrolls has a plurality of transition and stepped portions.

8. A scroll type compressor according to claim 1 wherein said stepped portion is positioned at an angle $\alpha$ on said end plate and said transition portion is positioned at a location $\alpha-\pi$.

9. A scroll type compressor according to claim 4 wherein said stepped portion is positioned at an angle $\alpha$ on said end plate and said transition portion is positioned at a location $\alpha-\pi$.

10. In a scroll type compressor including a housing having a fluid inlet port and a fluid outlet port, a fixed scroll fixedly disposed relative to said housing and having a circular end plate from which a first spiral wrap extends axially into an operative interior area of said housing, an orbiting scroll having a circular end plate from which a second spiral wrap extends axially, said first and second spiral wraps interfitting at an angular and radial offset to make a plurality of line contacts to define at least one pair of sealed-off fluid pockets within said operative interior area, a driving mechanism operatively connected to said orbiting scroll to effect orbital motion of said orbiting scroll so that the volume of the fluid pockets changes during the orbital motion of said orbiting scroll, the improvement comprising:

a transition portion on each of said spiral wraps, said transition portion defining an inner wrap portion extending from said transition portion toward the inner end of the spiral wrap and an outer wrap portion extending from said transition portion toward the outer end of the spiral wrap, said outer wrap portion having a greater axial height than said inner wrap portion; and a concavely arcuate stepped portion on each of said end plates generally in registry with said transition portions, said stepped portion defining an inner end plate portion extending from said stepped portion toward the center of the end plate and an outer end plate portion extending from said stepped portion toward the periphery of the end plate, said outer end plate portion being deeper than said inner end portion to accommodate the interfitting outer wrap portion therein to permit orbital motion of said transition portion adjacent thereto.

11. A scroll type compressor according to claim 10 wherein said transition portions and said stepped portions are adapted to mutually effect fluid seals therebetween during at least a portion of the orbital movement of said orbiting scroll.

12. A scroll type compressor according to claim 11 wherein said transition portion is a convex semicylindrical surface which joins said inner and outer wrap portions and is parallel to the orbital axis of said orbiting scroll member, and said stepped portion is a semicylindrical surface which joins said inner and outer end plate portions and is parallel to said orbital axis.

13. A scroll type compressor according to claim 10 wherein said stepped portions are positioned at an angle $\alpha$ on said end plate and said transition portion is positioned at a location $\alpha-\pi$.

* * * * *